US011098946B2

(12) United States Patent
Liu et al.

(10) Patent No.: US 11,098,946 B2
(45) Date of Patent: Aug. 24, 2021

(54) DOOR-IN-DOOR HAVING DISPLAY SCREEN ASSEMBLY AND REFRIGERATOR HAVING THE SAME

(71) Applicant: HAIER SMART HOME CO., LTD., Shandong (CN)

(72) Inventors: Mingyong Liu, Qingdao (CN); Ning Wang, Qingdao (CN); Weijian Fu, Qingdao (CN); Yuan Wang, Qingdao (CN); Heng Zhang, Qingdao (CN); Shidong Li, Qingdao (CN)

(73) Assignees: HAIER SMART HOME CO., LTD., Qingdao (CN); QINGDAO HAIER REFRIGERATOR CO., LTD., Qingdao (CN)

( * ) Notice: Subject to any disclaimer, the term of this patent is extended or adjusted under 35 U.S.C. 154(b) by 0 days.

(21) Appl. No.: 17/042,826

(22) PCT Filed: Sep. 10, 2019

(86) PCT No.: PCT/CN2019/105070

§ 371 (c)(1),
(2) Date: Sep. 28, 2020

(87) PCT Pub. No.: WO2020/140471

PCT Pub. Date: Jul. 9, 2020

(65) Prior Publication Data

US 2021/0018252 A1 Jan. 21, 2021

(30) Foreign Application Priority Data

Jan. 4, 2019 (CN) ..... 201910008715.4

(51) Int. Cl.
*F25D 23/02* (2006.01)
*F25D 29/00* (2006.01)

(52) U.S. Cl.
CPC ..... *F25D 23/025* (2013.01); *F25D 29/005* (2013.01)

(58) Field of Classification Search
CPC ..... F25D 23/025; F25D 29/005; F25D 2400/361; F25D 23/02; F25D 23/028; F25D 2400/36; F25D 27/005; F25D 2323/023
See application file for complete search history.

(56) References Cited

U.S. PATENT DOCUMENTS 4,092,698 A * 5/1978 Brefka ..... G01R 1/04 361/622
4,966,004 A * 10/1990 Midlang ..... F25D 29/005 200/302.2

(Continued)

FOREIGN PATENT DOCUMENTS

CN 205619649 U 10/2016
CN 206695474 U 12/2017

(Continued)

*Primary Examiner* — Hiwot E Tefera
(74) *Attorney, Agent, or Firm* — Cheng-Ju Chiang

(57) ABSTRACT

The present invention discloses a door-in-door having a display screen assembly and a refrigerator having the same. The door-in-door comprises a first door body and a second door body; the first door body has a transparent panel, and the second door body is provided with a display screen assembly. When the first door body closes the cabinet, a display interface of the display screen assembly is displayed through the transparent panel of the first door body. According to the present invention, an operation state of the refrigerator can be learnt about without opening the first door body.

6 Claims, 7 Drawing Sheets

(56) References Cited

U.S. PATENT DOCUMENTS

| | | | | |
|---|---|---|---|---|
| 7,903,399 | B2 * | 3/2011 | Kim | H01L 51/0097 361/679.21 |
| 9,255,355 | B2 * | 2/2016 | Bas | D06F 39/00 |
| 2003/0115891 | A1 * | 6/2003 | Raab | F25D 29/005 62/126 |
| 2011/0156547 | A1 * | 6/2011 | Kaplan | F25D 29/005 312/204 |
| 2015/0052920 | A1 * | 2/2015 | Park | F25D 29/005 62/126 |
| 2016/0131420 | A1 * | 5/2016 | Park | G06F 3/0412 62/56 |
| 2016/0209110 | A1 * | 7/2016 | Cho | F25D 29/005 |
| 2017/0010040 | A1 * | 1/2017 | Kim | F25D 23/025 |
| 2017/0115049 | A1 * | 4/2017 | Ding | F25D 29/005 |
| 2017/0191745 | A1 * | 7/2017 | Choi | H05B 47/115 |
| 2017/0234609 | A1 * | 8/2017 | Park | F25D 29/005 345/174 |
| 2018/0202706 | A1 * | 7/2018 | Lee | F25D 23/028 |

FOREIGN PATENT DOCUMENTS

| | | | |
|---|---|---|---|
| CN | 206820267 | U | 12/2017 |
| CN | 108224889 | A | 6/2018 |
| CN | 108759265 | A | 11/2018 |

* cited by examiner

DOOR-IN-DOOR HAVING DISPLAY SCREEN ASSEMBLY AND REFRIGERATOR HAVING THE SAME

The present application claims priority to Chinese Patent Application No. 201910008715.4, filed to the Chinese Patent Office on Jan. 4, 2019 and titled "Door-In-Door Having Display Screen Assembly and Refrigerator Having the Same", the content of which is incorporated herein by reference in its entirety.

TECHNICAL FIELD

The present invention relates to the field of household appliance technologies and in particular to a door-in-door having a display screen assembly and a refrigerator having the same.

BACKGROUND

Refrigerators have become requisite household appliance at many homes. Along with scientific and technological progress, users have higher and higher requirements for the performance and visual viewing effects of the refrigerators.

In a conventional refrigerator, a display screen assembly is usually disposed on a door body to display a temperature of the refrigerator; with the development of science and technology, refrigerators having door-in-door prevail. To facilitate operation and observation, such refrigerators have the same design principle as refrigerators having a single door, i.e., a display screen assembly is disposed on the outer door. This mounting manner requires a complicated process, higher costs and occupation of the outer door; especially for a door-in-door refrigerator having a transparent panel, since the display screen is to be placed, the area of the glass panel needs to be reduced, which causes the viewing effect of the refrigerator not ideal enough.

SUMMARY

An object of the present invention is to provide a door-in-door having a display screen assembly and a refrigerator having the same.

In order to realize one of the objectives of the above invention, the present invention provides a door-in-door having a display screen assembly, the door-in-door being applied to a refrigerator and configured to close a cabinet of the refrigerator, the door-in-door comprising: a first door body contacting an outer space of the refrigerator, and a second door body pivotally connected to the first door body and disposed close to the cabinet of the refrigerator; the first door body comprises a transparent panel, the second door body is provided with a display screen assembly, where a display interface of the display screen assembly is displayed through the transparent panel of the first door body when the first door body closes the cabinet.

As a further improvement on the embodiment of the present invention, the display screen assembly comprises: a display main body detachably connected to the second door body and forming an accommodating space therein, a display screen disposed on the display main body and forming the display interface, and a control panel that is at least partially disposed in the accommodating space of the display main body to control content output by the display screen.

As a further improvement on the embodiment of the present invention, the display main body comprises: a front decorative plate and a rear decorative plate forming the accommodating space with the front decorative plate, the display screen is embedded in the front decorative plate, and the rear decorative plate is detachably connected to the second door body.

As a further improvement on the embodiment of the present invention, the rear decorative plate comprises two symmetrically-arranged first side walls, each of the first side walls is inwardly recessed to form a first groove, and each of the first grooves is provided with an elastic snap, and a first snap-fitting portion is formed between the elastic snap and a first groove side wall of the first groove away from the elastic snap;

the second door body protrudes outwards at a position engaging with the first snap-fitting portion to form a second groove, an outer wall of the second groove forms a first embedding portion, and when the installation of the display screen assembly is finished, the first embedding portion is embedded in the first snap-fitting portion so that the display screen assembly is detachably connected to the second door body.

As a further improvement on the embodiment of the present invention, a bottom wall of the first groove is provided with a through hole, the elastic snap comprises: an extension plate extending from a portion of the inner wall of the through hole towards a central position of the through hole, and an abutting stage which is disposed at an end of the extension plate adjacent to the central position of the through hole and extends towards an opening of the first groove, and the first snap-fitting portion is formed between a side wall of the abutting stage and the first groove side wall of the first groove away from the elastic snap.

As a further improvement on the embodiment of the present invention, the second door body comprises: a second door frame 21, the first embedding portion being formed on an inner side wall of the second door frame; a third groove sharing part of the side wall with the second groove is protrusively outwardly provided on the inner side wall of the second door frame, an outer wall surface of the third groove not sharing the side wall with the second groove abuts against the inner wall surface of the first groove, the abutting stage is disposed corresponding to the third groove, and a portion of the extension plate not provided with the abutting stage is disposed corresponding to the second groove.

As a further improvement on the embodiment of the present invention, a fourth groove sharing part of the side wall with the third groove is disposed protrusively outwardly on the inner side wall of the second door frame, an outer wall surface of the fourth groove not sharing the side wall of the third groove abuts against the inner wall surface of the first groove, a bottom wall of at least one of the fourth grooves runs through an interior of the second door frame, the rear decorative plate is provided with at least one accommodating hole communicated with the accommodating space, and the accommodating hole is disposed corresponding to the fourth groove whose bottom wall runs through when the mounting of the display screen assembly is completed.

As a further improvement on the embodiment of the present invention, the door-in-door further comprises a sterilization module which is detachably connected to the display screen assembly and communicatively connected to the control panel to output its operation control instructions and control results through the display screen; the second door body is further provided with an accommodating box which is configured to accommodate items in cooperation with the sterilization module.

As a further improvement on the embodiment of the present invention, the accommodating box has an opening facing a side of the cabinet or the accommodating box is a drawer formed on the second door and being pushable towards or pullable away from the cabinet of the refrigerator.

In order to realize another one of the objectives of the above invention, an embodiment of the present invention provides a refrigerator, the refrigerator comprises a cabinet, and the door-in-door having the display screen assembly as described above, and the door-in-door is used to close the cabinet.

Advantageous effects of the present invention are as follows: in the door-in-door with display screen assembly and the refrigerator having the same according to the present invention, the display screen assembly is disposed on the second door body arranged close to the cabinet, so that the operation state of the refrigerator may be learnt about without opening the first door body, which does not destroy the transparent display effect of the first door body and meanwhile may make the appearance of the refrigerator more concise.

DETAILED DESCRIPTION

The present invention will be described in detail below in conjunction with the embodiments shown in the figures. However, these embodiments do not limit the present invention, and structural or functional modifications made by those skilled in the art based on these embodiments are all included in the protection scope of the present invention.

The present invention relates to a door-in-door refrigerator. The refrigerator comprises a cabinet, and a door-in-door for closing the cabinet. The number of the door-in-doors is not limited.

Figure 1:
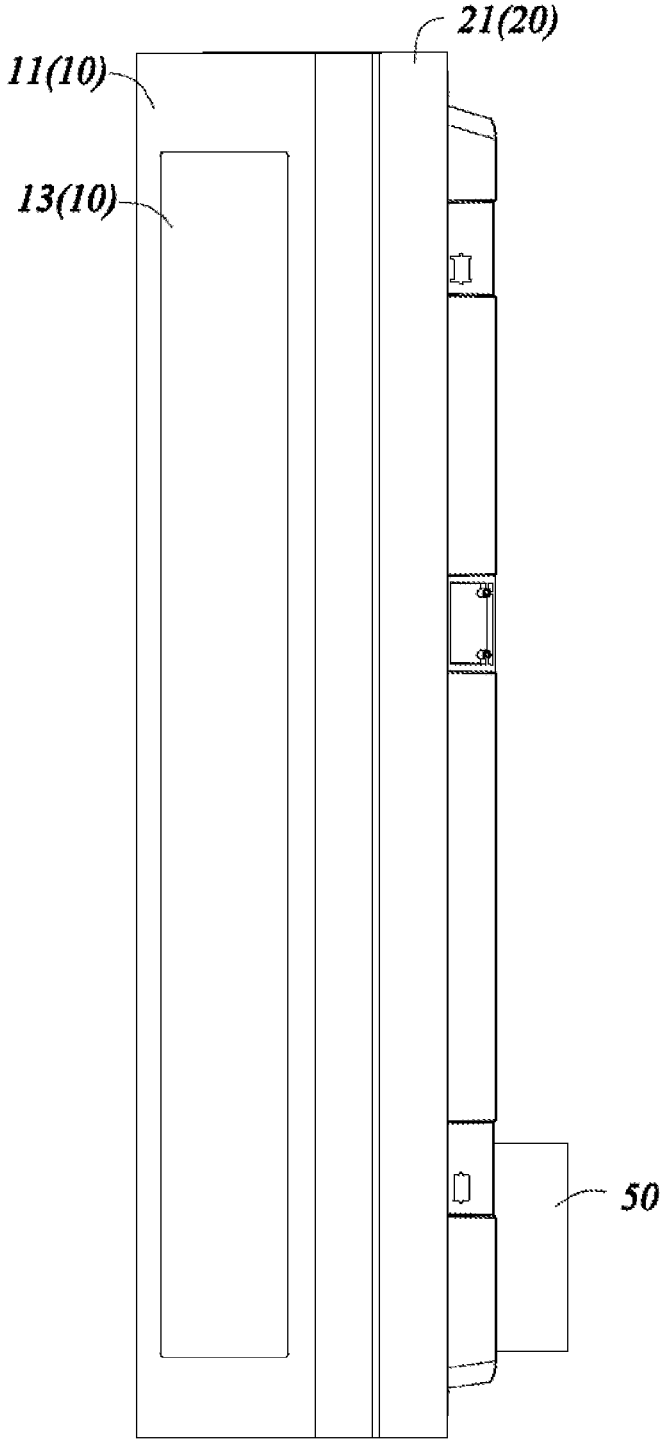
FIG. 1 is an overall structural schematic view of a door-in-door having a display screen assembly in an embodiment of the present invention.
Figure 2:
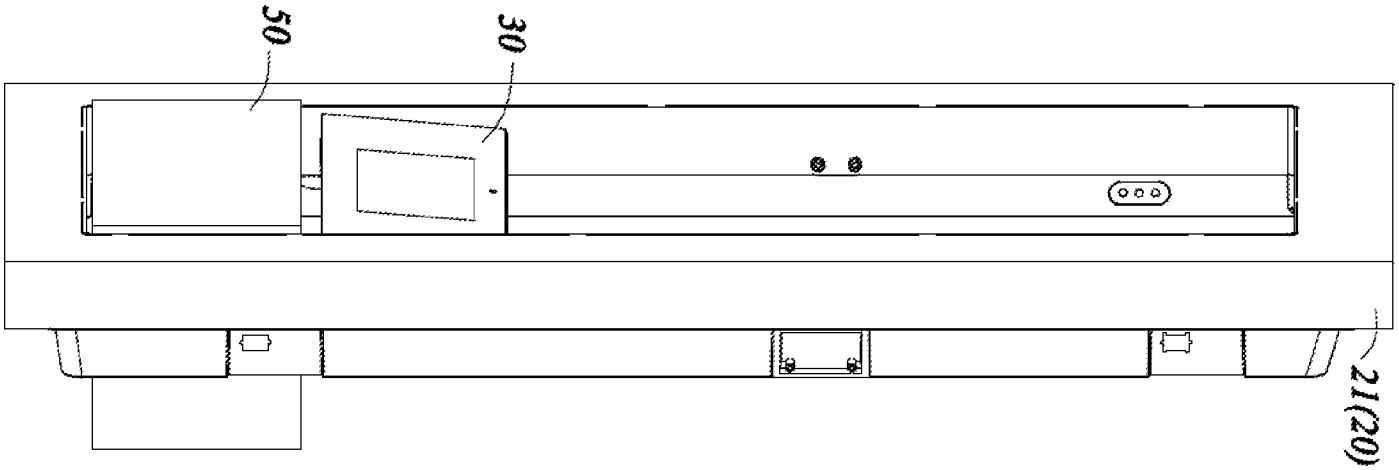
FIG. 2 is a structural schematic view of engagement of a second door body and the display screen assembly of FIG. 1.

Referring to FIG. 1, the door-in-door comprises: a first door body 10 contacting an outer space of the refrigerator, and a second door body 20 pivotally connected to the first door body 10 and disposed close to the cabinet of the refrigerator.

The first door body 10 comprises: a first door frame 11 and a transparent panel 13 embedded in the first door frame 11, and an internal space of the refrigerator can be observed through the transparent panel 13 which is for example a glass panel. The second door body 20 comprises: a second door frame 21, and parts such as bottle holders and shelves which are disposed on the second door frame 21 and configured to carry items, which are not described in detail here.

With reference to FIG. 2, FIG. 3, FIG. 4, FIG. 5, FIG. 6, FIG. 7 and FIG. 8, the second door body 20 is provided with a display screen assembly 30, wherein when the first door body 10 closes the cabinet, a display interface of the display screen assembly 30 is displayed through the transparent panel 13 of the first door body 10.

In an implementation of the present invention, the display screen assembly 30 comprises: a display main body detachably connected to the second door body 20 and forming an accommodating space therein, a display screen 35 disposed on the display main body and forming the display interface, and a control panel that is at least partially disposed in the accommodating space of the display main body to control content output by the display screen 35; the display screen 35 may be a TFT screen to facilitate the user to control by touch, or a traditional screen which can be operated by using an external control button. A regulating frequency of the refrigerator is generally not very high. According to the present invention, the operating status of the refrigerator may be understood without opening the first door 10. If the content output by the display screen 35 needs to be regulated, the first door 10 may be opened to expose the display screen, and the display screen is regulated. As such, the overall effect of the transparent door is not destroyed, and meanwhile the appearance of the refrigerator may be made more concise.

Figure 3:
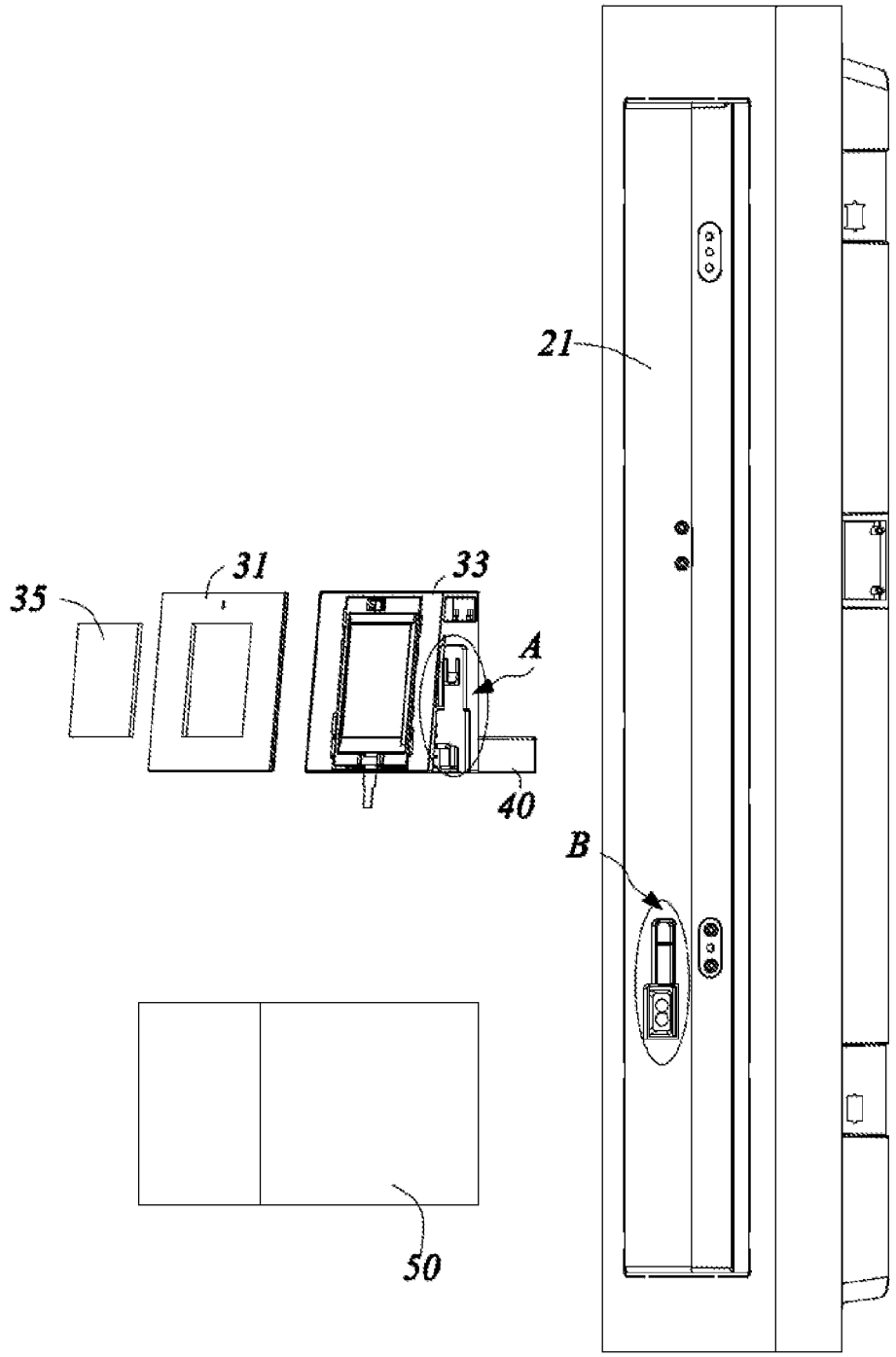
FIG. 3 is an exploded structural schematic view of FIG. 2.

In a preferred embodiment of the present invention, as shown in FIG. 3, the display main body comprises: a front decorative plate 31 and a rear decorative plate 33 forming the accommodating space with the front decorative plate 31, wherein the display screen 35 is embedded in the front decorative plate 31, and the rear decorative plate 32 is detachably connected to the second door body 20.

In an implementation of the present invention, the display screen assembly 30 may be connected to the second door body 20 in a variety of ways, such as gluing, screw fixation, and snap connection.

Figure 4:
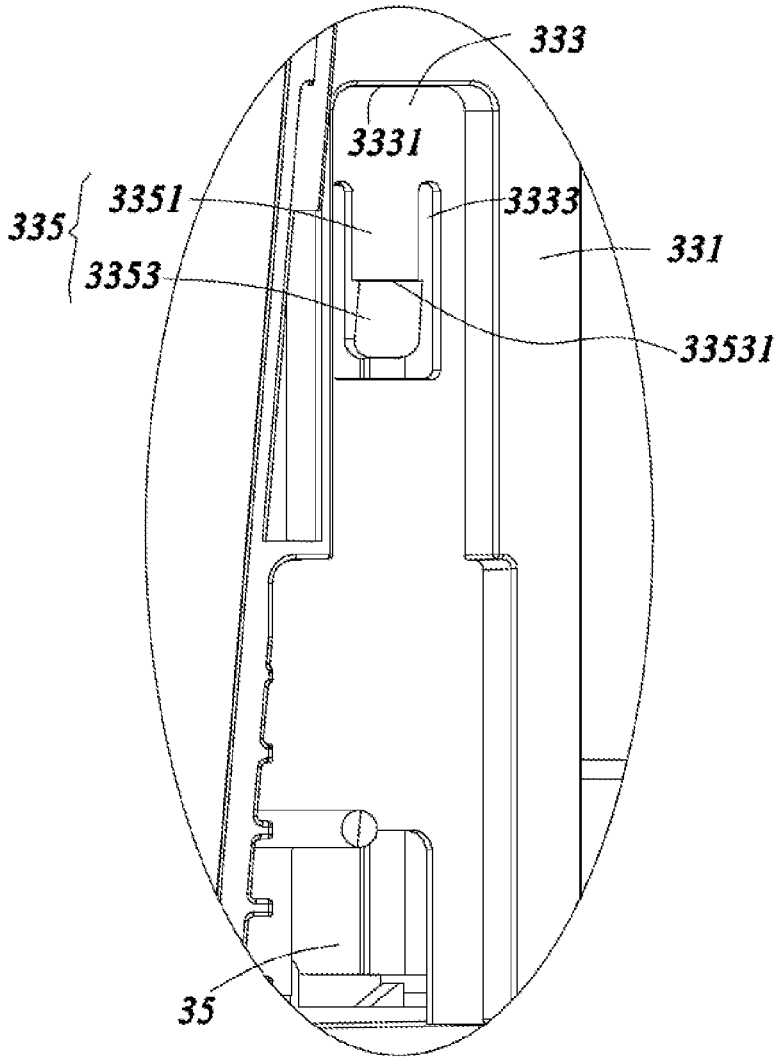
FIG. 4 is an enlarged structural schematic view of a component shown in circle A of FIG. 3.
Figure 5:
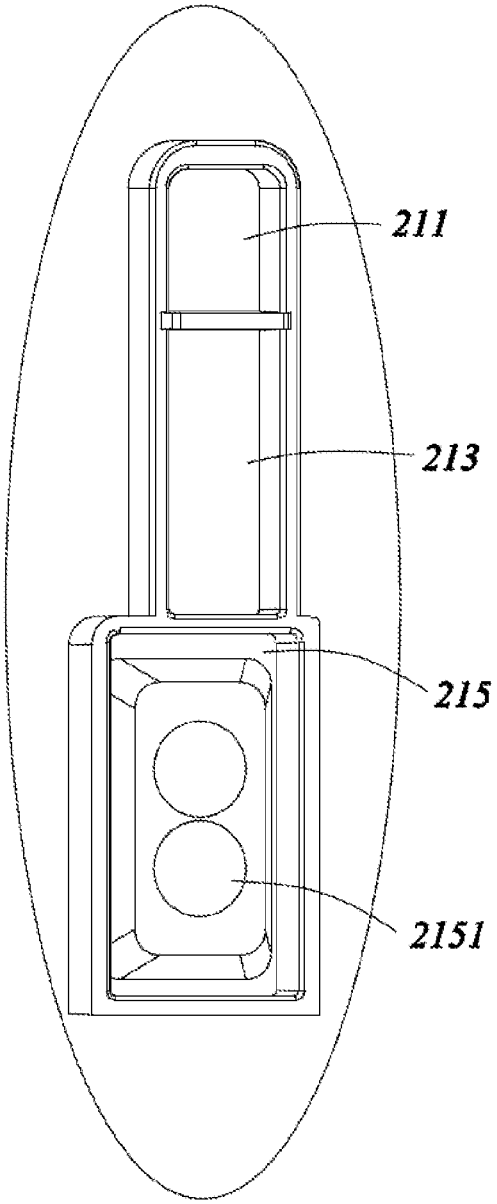
FIG. 5 is an enlarged structural schematic view of a component shown in circle B of FIG. 3.
Figure 6:
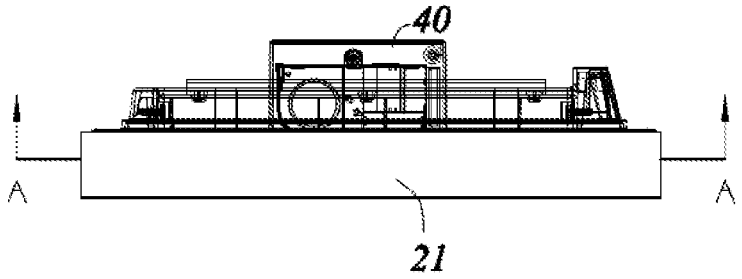
FIG. 6 is a structural schematic view of a receiving box not shown in FIG. 2 as viewed from another angle.
Figure 7:
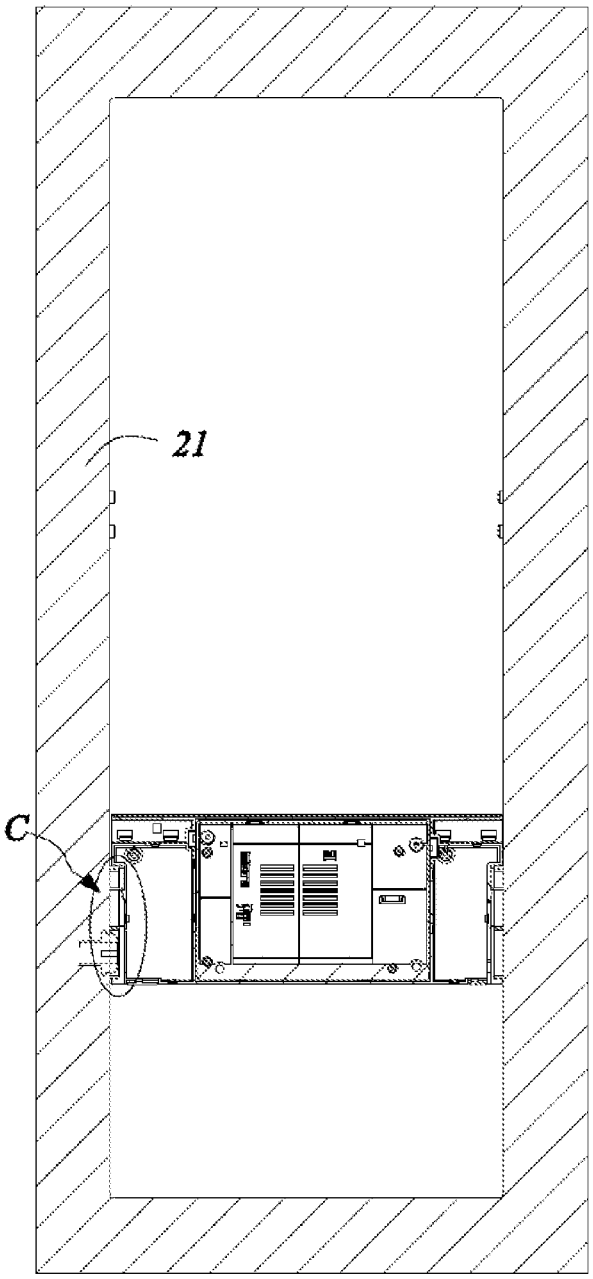
FIG. 7 is a cross-sectional view of FIG. 6 taken along line A-A.
Figure 8:
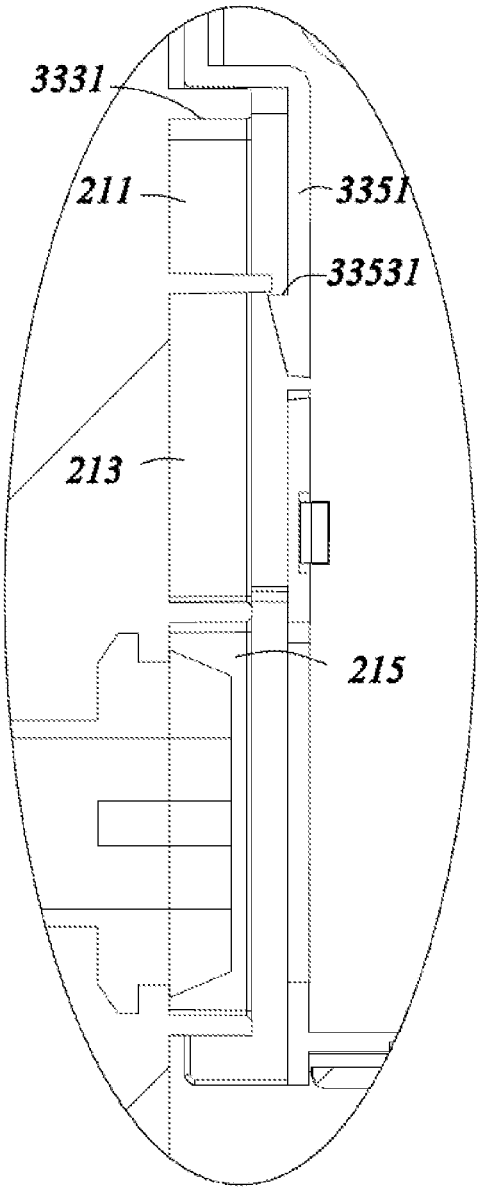
FIG. 8 is an enlarged structural schematic view of a component shown in circle C of FIG. 7.

As shown in FIG. 4, FIG. 5 and FIG. 8, in a specific example of the present invention, the display screen assembly 30 is detachably connected to the second door body 20 in a snap connection manner. Specifically, the rear decorative plate 33 comprises two symmetrically-arranged first side walls 331, each of the first side walls 331 is inwardly recessed to form a first groove 333, and each of the first grooves 333 is provided with an elastic snap 335, and a first snap-fitting portion is formed between the elastic snap 335 and a first groove side wall 3331 of the first groove 333 away from the elastic snap 335; the second door body 20 protrudes outwards at a position engaging with the first snap-fitting portion to form a second groove 211. An outer wall of the second groove 211 forms a first embedding portion. When the installation of the display screen assembly is finished, the first embedding portion is embedded in the first snap-fitting portion so that the display screen assembly is detachably connected to the second door body.

Preferably, a bottom wall of the first groove 333 is provided with a through hole 3333, and the elastic snap 335 comprises: an extension plate 3351 extending from a portion of the inner wall of the through hole 3333 towards a central position of the through hole 333, and an abutting stage 3353 which is disposed at an end of the extension plate 3351 adjacent to the central position of the through hole 3333 and extends towards an opening of the first groove 333. The first snap-fitting portion is formed between a side wall 33531 of the abutting stage 3353 and the first groove side wall 3331 of the first groove 333 away from the elastic snap 335.

In a process of assembling the display screen assembly 30 with the second door body 20, an external force presses the abutting stage 3353 so that the extension plate 3351 drives the abutting stage 3353 to move towards the interior of the through hole 3333. When the display screen assembly 30 moves to a mounting position relative to the second door body 20, the elastic snap 335 returns to the original position against the external force, and the outer wall of the second groove 211 abuts against the inner wall of the first groove 333 and the side wall 33531 of the abutting state 3353, whereby a structure that the first embedding portion is embedded into the first snap-fitting portion is formed so that the display screen assembly 30 is fixedly connected to the second door body 20.

In a preferred embodiment of the present invention, the first embedding portion is formed on the inner side wall of the second door frame 21; a third groove 213 sharing part of the side wall with the second groove 211 is protrusively outwardly provided on the inner side wall of the second door frame 21, an outer wall surface of the third groove 213 not sharing the side wall with the second groove 211 abuts against the inner wall surface of the first groove 333, the abutting stage 3353 is disposed corresponding to the third groove 213, and a portion of the extension plate 3351 not provided with the abutting stage 3353 is disposed corresponding to the second groove 211. With the third groove 212 being provided, the display screen assembly 30 can be more firmly installed on the second door body 20 through the cooperation of the first groove 333 and the third groove 213.

Further, in a preferred embodiment of the present invention, a fourth groove 215 sharing part of the side wall with the third groove 213 is disposed protrusively outwardly on the inner side wall of the second door frame 21, an outer wall surface of the fourth groove 215 not sharing the side wall of the third groove 213 abuts against the inner wall surface of the first groove 333, and a bottom wall of at least one of the fourth grooves 215 runs through the interior of the second door frame 21. The rear decorative plate 33 is provided with at least one accommodating hole 35 communicated with the accommodating space, and the accommodating hole 35 is disposed corresponding to the fourth groove 215 whose bottom wall runs through when the mounting of the display screen assembly 30 is completed.

Further, a communication member 2151 is further disposed at the bottom wall which is of the fourth groove 215 and runs through the interior of the second door frame 21. The shape of the communication member 2251 may be specifically set according to needs. For example, in an implementation of the present invention, the communication member 2151 has two communication paths for communicating the accommodating hole 35 with the interior of the second door frame 21: one communication path is used to guide a power line in the display screen assembly into the interior of the second door frame 21, and the other communication path is used to guide a heating pipe partially disposed in the accommodating space to enter the interior of the second door frame 21, the heating pipe being used to prevent a dew condensation phenomenon from occurring on the display screen assembly.

In a preferred embodiment of the present invention, the display screen assembly 30 is used to display an operation state of the refrigerator in real time, for example, a door opening or closing state of the refrigerator, a temperature of each compartment, etc.; further, the display screen assembly 30 is connected with a camera device in the refrigerator and used to display a state of foods in the refrigerator; in a specific example of the present invention, the door-in-door further comprises a sterilization module 40 which is detachably connected to the display screen assembly 30 and communicatively connected to the control panel to output its operation control instructions and control results through the display screen 35; the second door body 20 is further provided with an accommodating box 50 which is configured to accommodate items in cooperation with the sterilization module 40, and the sterilization module 40 is used to sterilize items in the accommodating box 50.

Preferably, the accommodating box 50 has an opening facing a side of the cabinet or the accommodating box is a drawer formed on the second door 20 and being pushable towards or pullable away from the cabinet of the refrigerator, thereby facilitating the user to put or take items.

It needs to be appreciated that the sterilization module 40 may also be configured as a moisturizing module or other functional modules that cooperate with the accommodating box 50, which is not described in detail here.

In summary, in the door-in-door with display screen assembly and the refrigerator having the same according to the present invention, the display screen assembly is disposed on the second door body arranged close to the cabinet, so that the operation state of the refrigerator may be learnt about without opening the first door body, which does not destroy the transparent display effect of the first door body and meanwhile may make the appearance of the refrigerator more concise.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A door-in-door having a display screen assembly, the door-in-door being applied to a refrigerator and configured to close a cabinet of the refrigerator, the door-in-door comprising: a first door body contacting an outer space of the refrigerator, and a second door body pivotally connected to the first door body and disposed close to the cabinet of the refrigerator;

wherein the first door body comprises a transparent panel, the second door body is provided with a display screen assembly, where a display interface of the display screen assembly is displayed through the transparent panel of the first door body when the first door body closes the cabinet, the display screen assembly comprises a display main body detachably connected to the second door body and forming an accommodating space therein, a display screen disposed on the display main body and forming the display interface, and a control panel that is at least partially disposed in the accommodating space of the display main body to control content output by the display screen;

the display main body comprises a front decorative plate and a rear decorative plate forming the accommodating space with the front decorative plate, the display screen is embedded in the front decorative plate, and the rear decorative plate is detachably connected to the second door body;

the rear decorative plate comprises two symmetrically-arranged first side walls, each of the first side walls is inwardly recessed to form a first groove, and each of the first grooves is provided with an elastic snap, and a first snap-fitting portion is formed between the elastic snap and a first groove side wall of the each first groove away from the elastic snap;

the second door body protrudes outwards at a position engaging with the first snap-fitting portion to form a second groove, an outer wall of the second groove forms a first embedding portion, and when installation of the display screen assembly is finished, the first embedding portion is embedded in the first snap-fitting portion so that the display screen assembly is detachably connected to the second door body;

a bottom wall of the each first groove is provided with a through hole, the elastic snap comprises an extension plate extending from a portion of an inner wall of the through hole towards a central position of the through hole, and an abutting stage which is disposed at an end of the extension plate adjacent to the central position of the through hole and extends towards an opening of the each first groove, and the first snap-fitting portion is formed between a side wall of the abutting stage and the first groove side wall of the each first groove away from the elastic snap.

2. The door-in-door having a display screen assembly according to claim 1, wherein the second door body comprises a second door frame, the first embedding portion being formed on an inner side wall of the second door frame; a third groove sharing a part of a side wall of the third groove with the second groove is protrusively outwardly provided on the inner side wall of the second door frame, an outer wall surface of the third groove not sharing the side wall with the second groove abuts against an inner wall surface of the each first groove, the abutting stage is disposed corresponding to the third groove, and a portion of the extension plate not provided with the abutting stage is disposed corresponding to the second groove.

3. The door-in-door having a display screen assembly according to claim 2, wherein a fourth groove sharing a part of a side wall of the fourth groove with the third groove is disposed protrusively outwardly on the inner side wall of the second door frame, an outer wall surface of the fourth groove not sharing the side wall with the third groove abuts against the inner wall surface of the each first groove, a bottom wall of the fourth groove runs through an interior of the second door frame, the rear decorative plate is provided with at least one accommodating hole communicated with the accommodating space, and the at least one accommodating hole is disposed corresponding to the fourth groove so that the bottom wall of the fourth groove runs through the at least one accommodating hole when mounting of the display screen assembly is completed.

4. The door-in-door having a display screen assembly according to claim 1, wherein the door-in-door further comprises a sterilization module which is detachably connected to the display screen assembly and communicatively connected to the control panel to output its operation control instructions and control results through the display screen; the second door body is further provided with an accommodating box which is configured to accommodate items in cooperation with the sterilization module.

5. The door-in-door having a display screen assembly according to claim 4, wherein the accommodating box has an opening facing a side of the cabinet or the accommodating box is a drawer formed on the second door body and being pushable towards or pullable away from the cabinet of the refrigerator.

6. A refrigerator, wherein the refrigerator comprises a cabinet, and the door-in-door having the display screen assembly according to claim 1, and wherein the door-in-door is used to close the cabinet.

* * * * *